US010843503B2

(12) United States Patent
Schumacher et al.

(10) Patent No.: US 10,843,503 B2
(45) **Date of Patent: *Nov. 24, 2020**

(54) CUTTER-CARRIER ASSEMBLY FOR USE WITH PENCIL SHARPENERS

(71) Applicant: Sanford, L.P., Atlanta, GA (US)

(72) Inventors: Michael J. Schumacher, Hilliard, OH (US); Chris W. Cicenas, Etna, OH (US)

(73) Assignee: Sanford L.P., Atlanta, GA (US)

( * ) Notice: Subject to any disclaimer, the term of this patent is extended or adjusted under 35 U.S.C. 154(b) by 245 days.

This patent is subject to a terminal disclaimer.

(21) Appl. No.: 15/937,368

(22) Filed: Mar. 27, 2018

(65) Prior Publication Data

US 2018/0222247 A1 Aug. 9, 2018

Related U.S. Application Data

(63) Continuation of application No. 14/988,112, filed on Jan. 5, 2016, now Pat. No. 9,956,812.

(51) Int. Cl.
*B43L 23/00* (2006.01)
*B43L 23/02* (2006.01)

(52) U.S. Cl.
CPC ..... *B43L 23/008* (2013.01); *B43L 23/02* (2013.01)

(58) Field of Classification Search
CPC ..... B43L 23/00; B43L 23/004; B43L 23/008; B43L 23/02; B43L 23/04; B43L 23/06; B43L 23/08; B43L 23/085
See application file for complete search history.

(56) References Cited

U.S. PATENT DOCUMENTS 6,470,929 B2 10/2002 Fregeolle
8,205,648 B2 6/2012 Hsu
(Continued)

FOREIGN PATENT DOCUMENTS

CA 2378548 A1 9/2002

*Primary Examiner* — Matthew Katcoff
(74) *Attorney, Agent, or Firm* — Eversheds Sutherland (US) LLP

(57) ABSTRACT

A dual cutter-carrier assembly that includes a rotatable carrier having a front portion, a rear portion, and a center portion, wherein the center portion defines an interior cavity that is adapted to receive a pencil to be sharpened; a first cutter pin mounted on the carrier, wherein the first cutter pin has a front portion having an annular groove formed therein; a first cutter rotatably and slidably mounted on the first cutter pin; a second cutter pin mounted on the carrier, wherein the second cutter pin has a front portion having an annular groove formed therein; a second cutter rotatably and slidably mounted on the second cutter pin; a contact plate mounted within the interior cavity at the rear portion of the carrier, having a first yoke mechanically coupled to the first cutter and a second yoke mechanically coupled to the second cutter, wherein the contact plate moves in the direction of a pencil that is being sharpened when the tip of the advancing pencil touches the contact plate, wherein the first and second yokes move the first and second cutters respectively in the same direction as the moving contact plate; and wherein, as the pencil advances to a predetermined distance through the interior cavity, the first and second cutters are adapted to move outward from the interior cavity and away from the tip of the pencil being sharpened.

19 Claims, 6 Drawing Sheets

(56) References Cited

U.S. PATENT DOCUMENTS

| | | | |
|---|---|---|---|
| 8,205,649 | B2 | 6/2012 | Yeh et al. |
| 8,225,827 | B2 | 7/2012 | Dunlap |
| 8,353,323 | B2 | 1/2013 | Schumacher et al. |
| 8,505,596 | B2 | 8/2013 | Yeh et al. |
| 9,352,608 | B2 | 5/2016 | Hsu |

CUTTER-CARRIER ASSEMBLY FOR USE WITH PENCIL SHARPENERS

CROSS-REFERENCE TO RELATED APPLICATIONS

The present application is a continuation of U.S. application Ser. No. 14/988,112, filed Jan. 5, 2016, which is incorporated by reference herein in its entirety.

BACKGROUND OF THE INVENTION

The described invention relates in general to a cutting devices used in pencil sharpeners and the like, and more specifically to a dual fly-away cutter-carrier assembly for use in pencil sharpeners of various types. Certain aspects of this invention may be used with electric sharpeners that are consumer products or that are intended for commercial or industrial applications.

Commercially available electric pencil sharpeners may include cutter-carriers (i.e., the cutting assembly within the pencil sharpener that actually sharpens the pencil) having single helical cutters utilizing various "fly-away" cutter designs. In such products, the sharpened pencil point typically contacts a moveable plate at the end of a conical bore that is part of the cutter-carrier, thereby causing the cutter to be moved away from the pencil in a direction out of the conical bore, thereby greatly reducing or eliminating further sharpening of the pencil. Some of these products also include a mechanical linkage to the pencil-tip plate that extends outside the cutter carrier for the purpose of triggering an electrical switch to provide motor shut-off or a visible and/or potentially audible indication that the sharpening process is complete.

Other commercially available electric pencil sharpeners with electric stop or motor shut-off capabilities provide cutter-carriers having two separate cutters, but without the fly-away feature. Such sharpeners do, however, typically include the pencil-tip moveable plate and mechanical linkage thereto that extends outside the cutter carrier. These products do not rely on the removal of the helical cutters from the conical bore that is part of the cutter-carrier for indicating that sharpening is complete, but rather on motor shut-off or a visible and/or potentially audible indicator. In such products, one of the two helical cutters is typically foreshortened to provide adequate space within the cutter-carrier assembly for the pencil-tip plate. In this arrangement, the portion of the cutter that usually sharpens the harder and more abrasive core material of the pencil is removed, leaving, as in single-cutter designs, just one helical cutter that must absorb the primary wear associated with sharpening pencils or other items. Furthermore, when two cutter systems that include a mechanical-linkage feature are used to shut off the electric motor, because the cutters are fixed in relation to the conical cavity of the carrier, the cutting edges of the cutters are usually still engaged with the pencil casing and core when sharpening stops. This often results in undesirable resistance to removing the pencil from the sharpener. Accordingly, there is an ongoing need to for a dual cutter-carrier assembly that includes the fly-away feature, but that does not suffer from the inadequacies discussed above.

SUMMARY OF THE INVENTION

The following provides a summary of certain exemplary embodiments of the present invention. This summary is not an extensive overview and is not intended to identify key or critical aspects or elements of the present invention or to delineate its scope.

In accordance with one aspect of the present invention, a first dual cutter-carrier assembly for use with pencil sharpeners is provided. This dual cutter-carrier assembly includes a rotatable carrier having a front portion, a rear portion, and a center portion, wherein the center portion defines an interior cavity that is adapted to receive a pencil to be sharpened; a first cutter pin mounted on the carrier at a predetermined angle, wherein the first cutter pin has a front portion and a rear portion, and wherein an annular groove is formed in the front portion of the first cutter pin; a first cutter rotatably and slidably mounted on the first cutter pin, wherein the first cutter extends a predetermined distance into the interior cavity for removing material from a pencil being sharpened; a second cutter pin mounted on the carrier at a predetermined angle, wherein the second cutter pin has a front portion and a rear portion, and wherein an annular groove is formed in the front portion of the second cutter pin; a second cutter rotatably and slidably mounted on the second cutter pin, wherein the second cutter extends a predetermined distance into the interior cavity for removing material from a pencil being sharpened; a contact plate mounted within the interior cavity at the rear portion of the carrier, wherein the contact plate includes a first yoke mechanically coupled to the first cutter and a second yoke mechanically coupled to the second cutter, wherein the contact plate moves in the direction of a pencil that is being sharpened when the tip of the advancing pencil touches the contact plate, wherein the first and second yokes move the first and second cutters respectively in the same direction as the moving contact plate; and wherein, as the pencil advances to a predetermined distance through the interior cavity, the first and second cutters are adapted to move outward from the interior cavity and away from the tip of the pencil being sharpened.

In accordance with another aspect of the present invention, a second dual cutter carrier assembly for use with pencil sharpeners is provided. This dual cutter-carrier assembly includes a rotatable carrier having a front portion, a rear portion, and a center portion, wherein the center portion defines an interior cavity that is adapted to receive a pencil to be sharpened; a first cutter pin mounted on the carrier at a predetermined angle, wherein the first cutter pin has a front portion and a rear portion, wherein an annular groove is formed in the front portion of the first cutter pin, and wherein a first cutter bushing having an inner bore is slidably mounted on the front portion of the first cutter pin; a first cutter rotatably and slidably mounted on the first cutter pin, wherein the first cutter is retained in a cutting position by the first cutter bushing, and wherein the first cutter extends a predetermined distance into the interior cavity for removing material from a pencil being sharpened; a first cutter gear mechanically coupled to the first cutter, wherein the first cutter gear is operative to rotate the first cutter; a second cutter pin mounted on the carrier at a predetermined angle, wherein the second cutter pin has a front portion and a rear portion, wherein an annular groove is formed in the front portion of the second cutter pin, and wherein a second cutter bushing having an inner bore is slidably mounted on the front portion of the second cutter pin; and a second cutter rotatably and slidably mounted on the second cutter pin, wherein the second cutter is retained in a cutting position by the second cutter bushing, and wherein the second cutter extends a predetermined distance into the interior cavity for removing material from a pencil being sharpened; a second cutter gear mechanically coupled to the second cutter, wherein the second cutter gear is operative to rotate the second cutter; a contact plate mounted within the interior cavity at the rear portion of the carrier, wherein the contact plate includes a first yoke mechanically coupled to the first cutter and a second yoke mechanically coupled to the second cutter, wherein the contact plate moves in the direction of a pencil that is being sharpened when the tip of the advancing pencil touches the contact plate, wherein the first and second yokes move the first and second cutters respectively in the same direction as the moving contact plate; and wherein, as the pencil advances through the interior cavity, the inner bores of the cutter bushings reach the annular grooves in the cutter pins, thereby causing the cutter bushings to no longer retain the cutters in the cutting position, whereby the cutters then move outward away from the interior cavity and away from the tip of the pencil being sharpened; and at least one spring mounted on the rear portion of the carrier, wherein the at least one spring returns the contact plate and the first and second cutters to a starting position when the pencil is removed from the interior cavity of the carrier.

In yet another aspect of this invention, a third dual cutter-carrier assembly for use with pencil sharpeners is provided. This dual cutter-carrier assembly includes a rotatable carrier having a front portion with first and second bearing surfaces formed therein, a rear portion, and a center portion, wherein the center portion defines an interior cavity that is adapted to receive a pencil to be sharpened; a first cutter pin slidably mounted on the carrier at a predetermined angle, wherein the first cutter pin has a front portion and a rear portion, and wherein an annular groove is formed in the front portion of the first cutter pin; a first cutter rotatably mounted on the first cutter pin, wherein the first cutter extends a predetermined distance into the interior cavity for removing material from a pencil being sharpened; a first cutter gear mechanically coupled to the first cutter, wherein the first cutter gear is operative to rotate the first cutter; a second cutter pin slidably mounted on the carrier at a predetermined angle, wherein the second cutter pin has a front portion and a rear portion, and wherein an annular groove is formed in the front portion of the second cutter pin; a second cutter rotatably mounted on the second cutter pin, wherein the second cutter extends a predetermined distance into the interior cavity for removing material from a pencil being sharpened; a second cutter gear mechanically coupled to the second cutter, wherein the second cutter gear is operative to rotate the second cutter; a contact plate mounted within the interior cavity at the rear portion of the carrier, wherein the contact plate includes a first yoke mechanically coupled to the first cutter and a second yoke mechanically coupled to the second cutter, wherein the contact plate moves in the direction of a pencil that is being sharpened when the tip of the advancing pencil touches the contact plate, wherein the first and second yokes move the first and second cutters respectively in the same direction as the moving contact plate; and wherein, as the pencil advances through the interior cavity, the annular grooves in the cutter pins reach the first and second bearing surfaces in the carrier thereby causing the cutter pins to no longer retain the cutters in the cutting position, whereby the cutters then move outward away from the interior cavity and away from the tip of the pencil being sharpened; and at least one spring mounted on the rear portion of the carrier, wherein the at least one spring returns the contact plate and the first and second cutters to a starting position when the pencil is removed from the interior cavity of the carrier.

Additional features and aspects of the present invention will become apparent to those of ordinary skill in the art upon reading and understanding the following detailed description of the exemplary embodiments. As will be appreciated by the skilled artisan, further embodiments of the invention are possible without departing from the scope and spirit of the invention. Accordingly, the drawings and associated descriptions are to be regarded as illustrative and not restrictive in nature.

BRIEF DESCRIPTION OF THE DRAWINGS

The accompanying drawings, which are incorporated into and form a part of the specification, schematically illustrate one or more exemplary embodiments of the invention and, together with the general description given above and detailed description given below, serve to explain the principles of the invention, and wherein.

DETAILED DESCRIPTION OF THE INVENTION

Figure 1B:
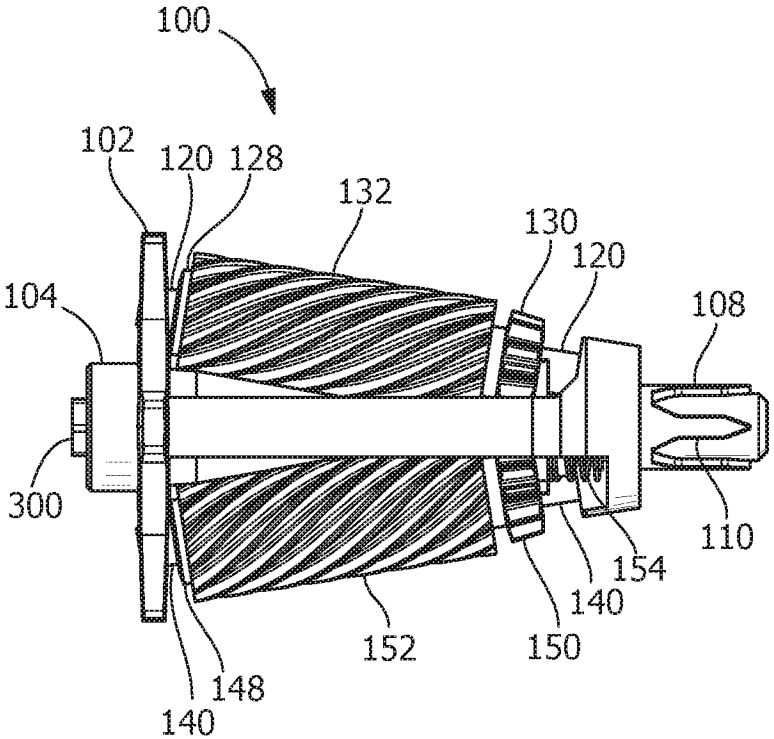
FIG. 1B is a side view of the cutter-carrier assembly of FIG. 1A.
Figure 1A:
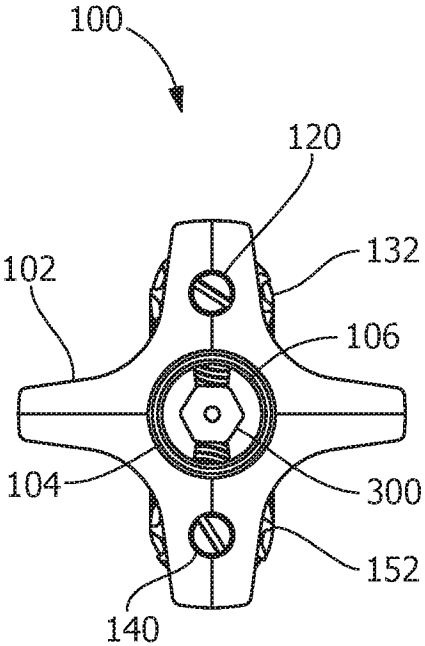
FIG. 1A is a first front view of a cutter-carrier assembly in accordance with a first exemplary embodiment of the present invention.
Figure 2B:
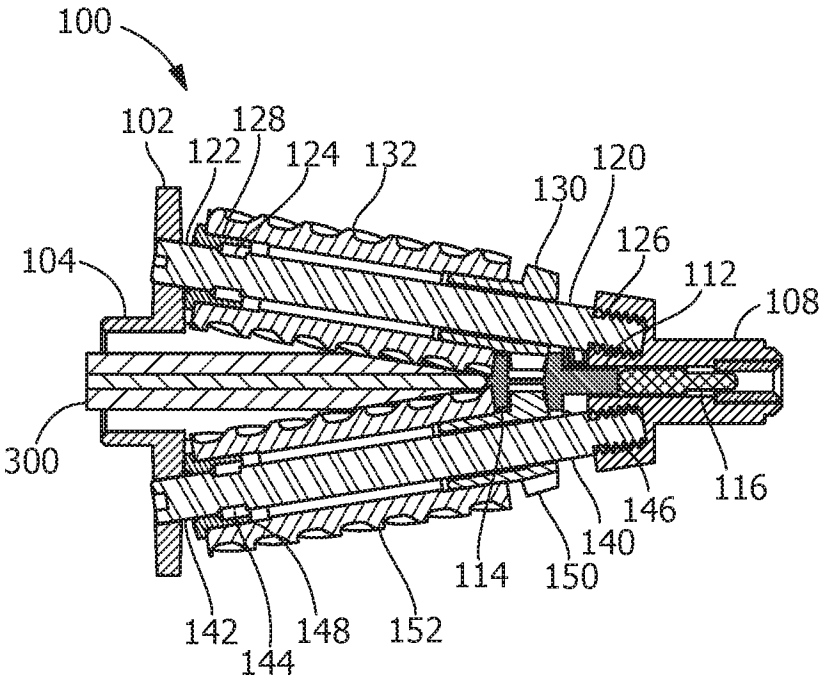
FIG. 2B is a cross-sectional side view of the cutter-carrier assembly of FIG. 1A, showing the helical cutters in the engaged position.
Figure 2A:
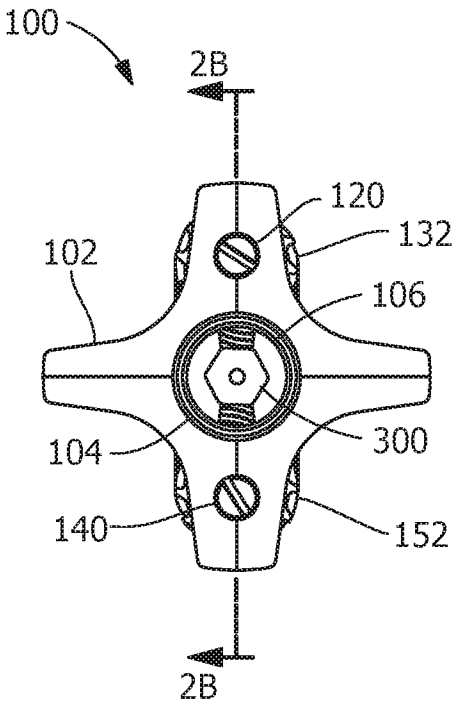
FIG. 2A is a second front view of the cutter-carrier assembly of FIG. 1A showing the location of the cross-section for FIG. 2B.
Figure 3B:
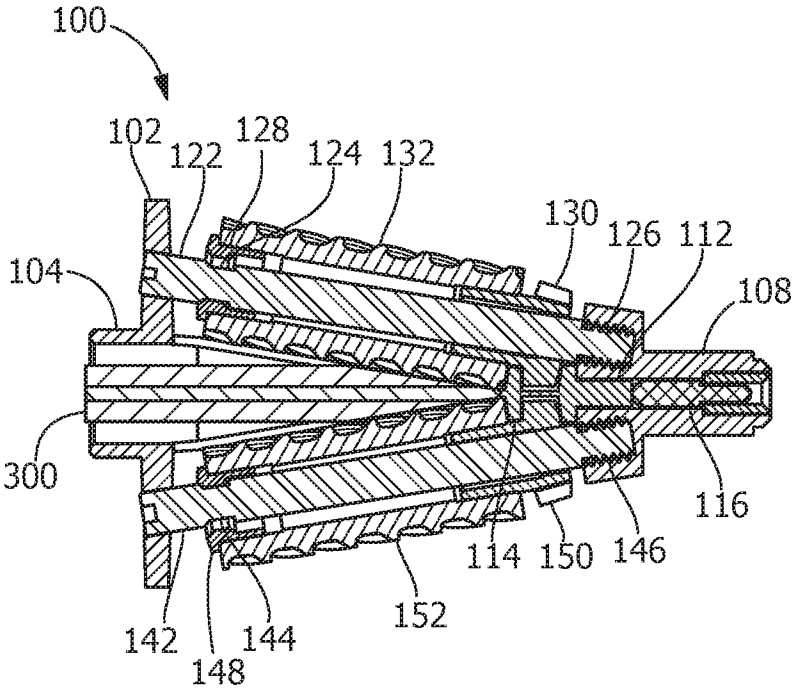
FIG. 3B is a cross-sectional side view of the cutter-carrier assembly of FIG. 1A, showing the helical cutters in the disengaged "fly-away" position.
Figure 3A:
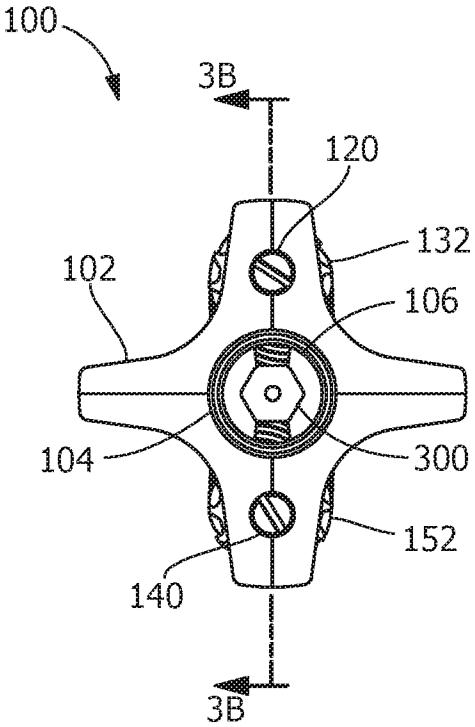
FIG. 3A is a third front view of the cutter-carrier assembly of FIG. 1A showing the location of the cross-section for FIG. 3B.
Figure 4B:
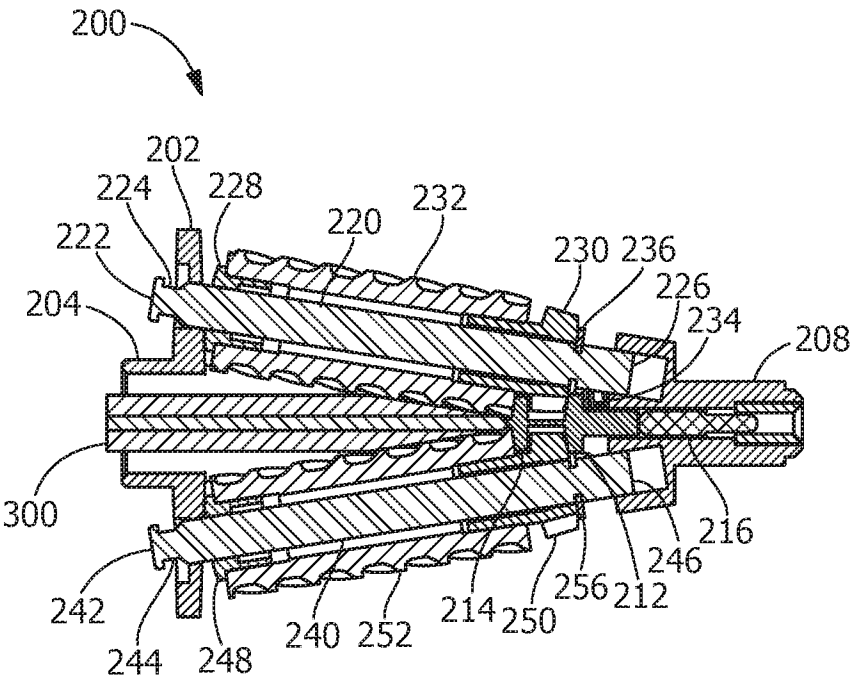
FIG. 4B is cross-sectional side view of the cutter-carrier assembly of FIG. 4A showing the helical cutters in the engaged position.
Figure 4A:
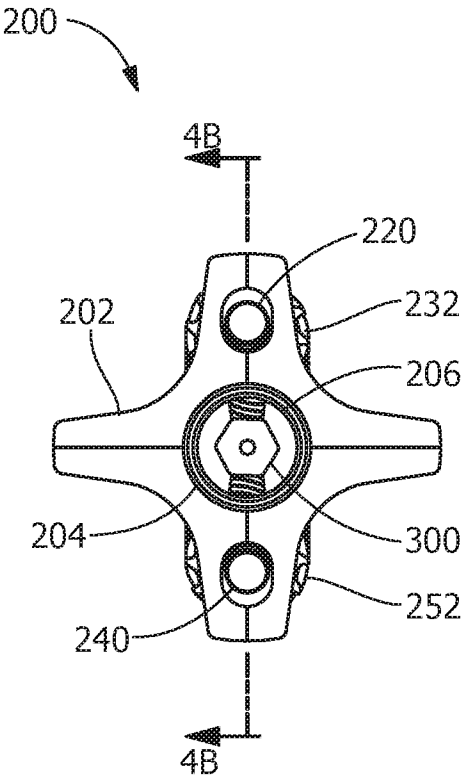
FIG. 4A is a first front view of a cutter-carrier assembly in accordance with a second exemplary embodiment of the present invention showing the location of the cross-section of FIG. 4B.
Figure 5B:
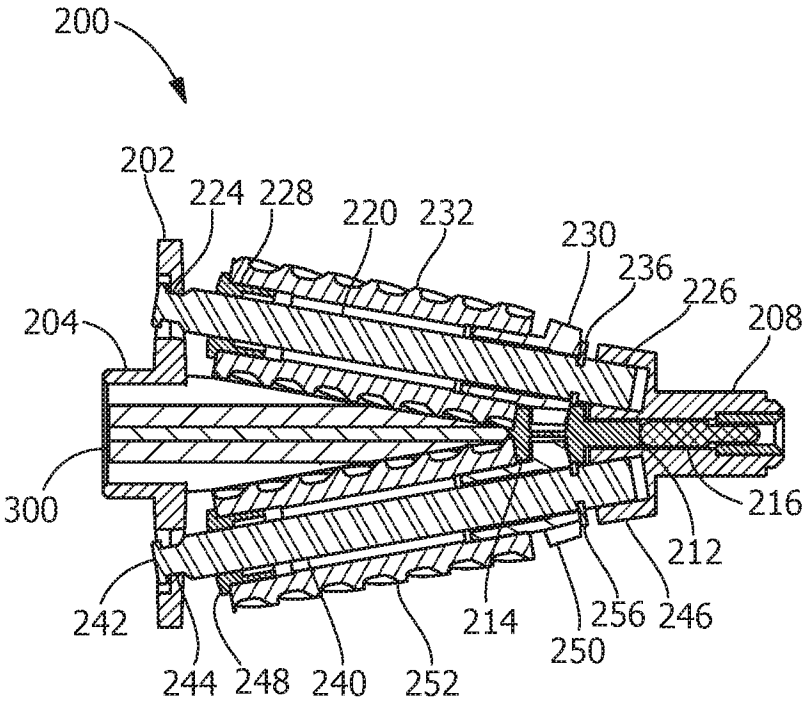
FIG. 5B is a cross-sectional side view of the cutter-carrier assembly of FIG. 4A showing the helical cutters in the disengaged "fly-away" position.
Figure 5A:
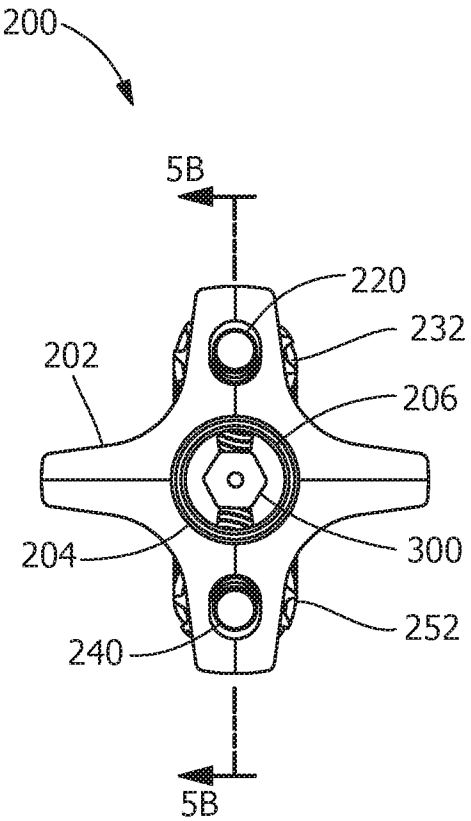
FIG. 5A is second front view of the cutter-carrier assembly of FIG. 4A showing the location of the cross-section for FIG. 5B.

Exemplary embodiments of the present invention are now described with reference to the Figures. Reference numerals are used throughout the detailed description to refer to the various elements and structures. In other instances, well-known structures and devices are shown in block diagram form for purposes of simplifying the description. Although the following detailed description contains many specifics for the purposes of illustration, a person of ordinary skill in the art will appreciate that many variations and alterations to the following details are within the scope of the invention. Accordingly, the following embodiments of the invention are set forth without any loss of generality to, and without imposing limitations upon, the claimed invention.

The present invention provides a removable (optionally) cutter-carrier assembly for pencil sharpeners, which includes dual fly-away helical cutters. These cutters retract (i.e., move away from the pencil and out of the conical cutter-carrier bore in which the pencil has been inserted) when the pencil is fully sharpened. This retraction indicates to the user that sharpening is complete and prevents unnecessary over-sharpening and wasting of pencils or other items that are being sharpened. A mechanical linkage that extends out of the cutter-carrier assembly may also be included for triggering external devices such as visual or audible indicators. In this invention, both helical cutters are full-length and are able to remove material from the pencil tip to the outside diameter of the pencil. This aspect improves cutting speed and permits the wear caused by the pencil core to be spread across twice as many cutting edges, thereby extending the life of the cutters. In certain embodiments of this invention, both helical cutters are full-length, but the fly-away feature of the helical cutters is either optional or is not present. In such embodiments, the annular grooves formed in the cutter pins (see discussion below) are absent.

With reference to FIGS. 1A-1B, 2A-2B, and 3A-3B, a first exemplary embodiment of cutter-carrier assembly 100 includes carrier 102, which further includes carrier front bushing surface 104 that defines the front portion of conical pencil cavity 106 (which is adapted to receive pencil 300), carrier shaft 108, and carrier shaft spline 110. Disposed within the narrow end of conical pencil cavity 106 is pencil contact "plate" or member 112, the front portion of which is connected to or formed integrally with contact plate yokes 114 and the rear portion of which is in contact with sliding link pin 116. First cutter pin 120 is mounted in the top portion of carrier 102 and includes front portion 122, which further includes annular groove 124 formed therein, and rear portion 126, which is threaded into carrier shaft 108. Slidably mounted on front portion 122 of first cutter pin 120 is first cutter bushing 128 and rotatably mounted on rear portion 126 of first cutter pin 120 is first cutter gear 130, which drives first helical cutter 132, which is rotatably and slidably mounted on first cutter pin 120. First return spring 134 (not visible in FIG. 1B) is positioned on the rear portion of carrier 102 behind first cutter gear 130. Second cutter pin 140 is mounted in the bottom portion of carrier 102 and includes front portion 142, which further includes annular groove 144 formed therein, and rear portion 146, which is threaded into carrier shaft 108. Slidably mounted on front portion 142 of second cutter pin 140 is second cutter bushing 148 and rotatably mounted on rear portion 146 of second cutter pin 140 is second cutter gear 150, which drives second helical cutter 152, which is rotatably and slidably mounted on second cutter pin 140. Second return spring 154 is positioned on the rear portion of carrier 102 behind second cutter gear 150.

Figure 6:
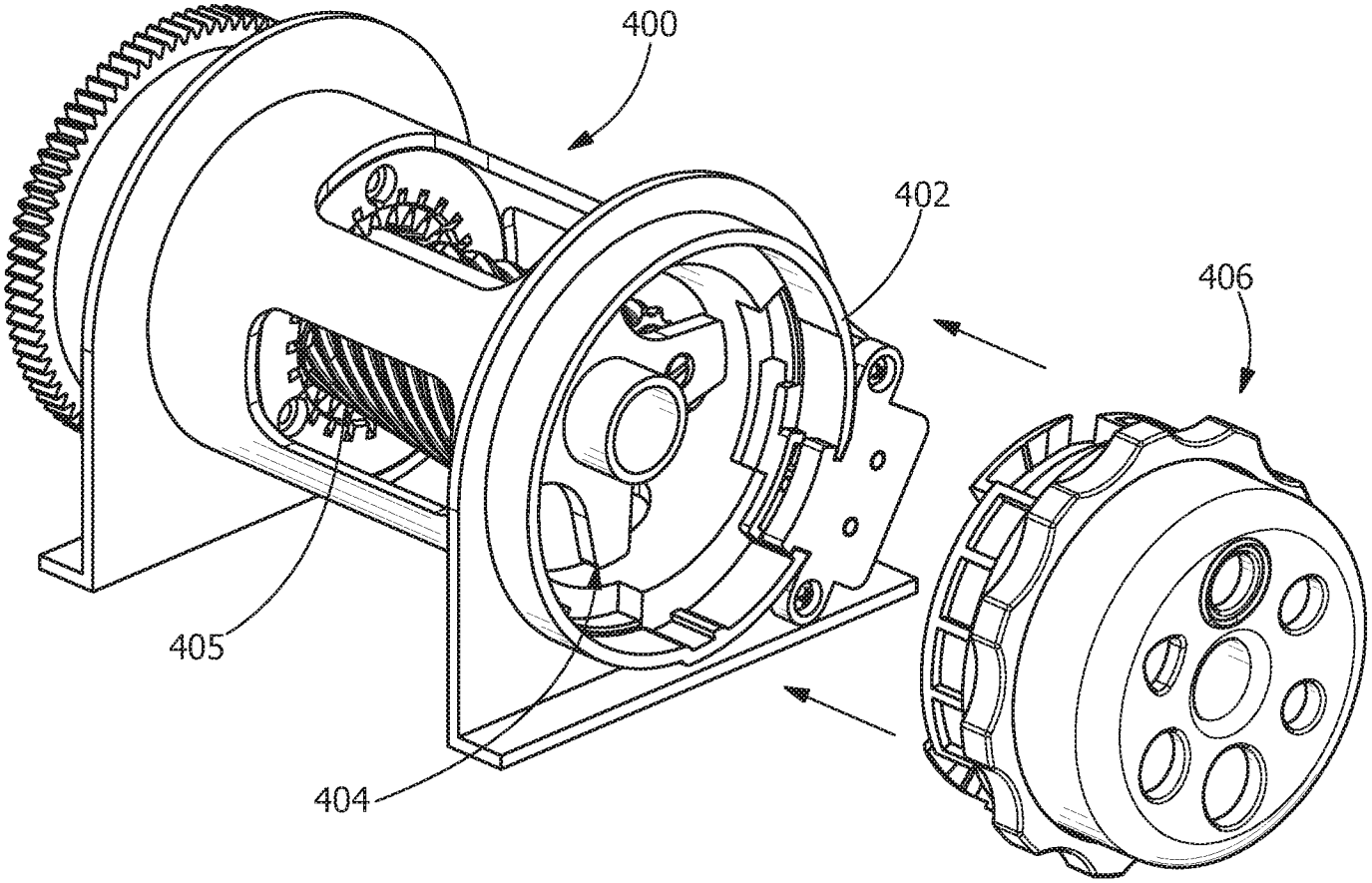
FIG. 6 is a perspective view of an electric pencil sharpener which is adapted to receive a removable embodiment of the cutter-carrier assembly of the present invention.

In the embodiment shown in FIGS. 1A-1B, 2A-2B, and 3A-3B, helical cutters 132 and 152 extend a predetermined distance into pencil cavity 106 for removing material from inserted pencil 300 as carrier 102 is rotated (by an external force) and helical cutters 132 and 152 rotate on cutter pins 120 and 140, driven by cutter gears 130 and 150, which are normally meshed to a fixed internal gear 405 around carrier 102 (see FIG. 6). As material (e.g., wood) is removed during the sharpening process, the end of pencil 300 advances farther into pencil cavity 106 toward pencil contact member 112. Upon reaching contact member 112, the tip of pencil 300 pushes contact member 112 in the direction of advancing pencil 300. Yokes 114, of which there are two, then slide helical cutters 132 and 152 in a similar direction along cutter pins 120 and 140, respectively. When the inner bores of cutter bushings 128 and 148 reach the reduced diameter of annular grooves 124 and 144 respectively, bushings 128 and 148 will no longer maintain helical cutters 132 and 152 in the cutting position and helical cutters 132 and 152 will move outward away from pencil cavity 106 driven by centrifugal force from the rotation of carrier 102 and/or contact with pencil 300. This effect causes the sharpening process to slow and/or cease, thereby significantly reducing the amount of material removed from pencil 300 by helical cutters 132 and 152. Upon removal of pencil 300 from pencil cavity 106, return springs 134 and 154 return pencil contact member 112 and helical cutters 132 and 152 to their starting position. Pencil contact member 112 may also be mechanically linked (e.g., sliding link pin 116) to an electrical switch or other electrical device through carrier shaft 108 for providing motor shut-off or visual, audible, or vibratory indication that sharpening is complete. Alternatively, or additionally, the mechanical linkage may limit travel of the pencil-tip plate, either fixed or adjustable and either on-carrier or off-carrier, to provide pencil-point size (diameter) control.

With reference to FIGS. 4A-4B and 5A-5B, a second exemplary embodiment of cutter-carrier assembly 200 includes carrier 202, which further includes carrier front bushing surface 204 that defines the front portion of conical pencil cavity 206 (which is adapted to receive pencil 300), carrier shaft 208, and carrier shaft spline 210. Disposed within the narrow end of conical pencil cavity 206 is pencil contact plate or member 212, the front portion of which is connected to or formed integrally with contact plate yoke 214 and the rear portion of which is in contact with sliding link pin 216. First cutter pin 220 is slidably mounted in the top portion of carrier 202 and includes front portion 222, which further includes annular groove 224 formed therein, and rear portion 226, which is inserted into carrier shaft 208. Mounted on front portion 222 of first cutter pin 220 is first cutter bushing 228 and rotatably mounted on rear portion 226 of first cutter pin 220 is first cutter gear 230, which drives first helical cutter 232, which is rotatably and slidably mounted on first cutter pin 220. First return spring 234 (not visible in FIG. 4B or 5B) is positioned on the rear portion of carrier 202 between carrier 202 and contact plate or member 212. Alternately, return spring 234 may be mounted on the front portion of carrier 202. First spring clip 236 is positioned on rear portion 226 of first cutter pin 220 just behind and abutting first cutter gear 230. Second cutter pin 240 is mounted in the bottom portion of carrier 202 and includes front portion 242, which further includes annular groove 244 formed therein, and rear portion 246, which is inserted into carrier shaft 208. Mounted on front portion 242 of second cutter pin 240 is second cutter bushing 248 and rotatably mounted on rear portion 246 of second cutter pin 240 is second cutter gear 250, which drives second helical cutter 252, which is rotatably and slidably mounted on second cutter pin 240. Second return spring 254 (not visible in FIG. 4B or 5B) is positioned on the rear portion of carrier 202 between carrier 202 and contact plate or member 212. Alternately, return spring 254 may be mounted on the front portion of carrier 202. Second spring clip 256 is positioned on rear portion 246 of second cutter pin 240 just behind and abutting second cutter gear 250. A portion of contact plate or member 212 engages spring clips 236 and 256 for returning the cutter pins to and helical cutters to their starting positions. An engaging rib or similar structure (not shown in the Figures) may be included on pencil contact plate or member 212 for engaging spring clips 236 and 256.

In the embodiment shown in FIGS. 4A-4B and 5A-5B, cutter pins 220 and 240 slide with helical cutters 232 and 252, respectively. As shown in the Figures, spring clips 236 and 256 are installed in corresponding grooves on cutter pins 220 and 240 for coupling the motion of helical cutters 232 and 252 to cutter pins 220 and 240, respectively. When the tip of pencil 300 touches contact "plate" or member 212, contact member 212 is pushed forward in the same direction as the advancing pencil. Yokes 214, of which there are two, drive helical cutters 232 and 252 by way of cutter gears 230 and 250. Cutter gears 230 and 250 then drive cutter pins 220 and 240 by way of spring clips 236 and 256 or other coupling means (in alternate embodiments, a second set of yokes formed on contact member 212 drive cutter pins 220 and 240 directly). When annular grooves 224 and 244 each reach a corresponding bearing surface on carrier 202 (see FIG. 5B), helical cutters 232 and 252 and cutter pins 220 and 240 move outward and away from pencil cavity 206 driven by the centrifugal force of rotating carrier 202 and by the force of the advancing pencil acting on helical cutters 232 and 252. This effect causes the sharpening process to slow and/or cease, thereby significantly reducing the amount of material removed from pencil 300 and preventing wastage of the pencil. This effect also indicates to the user that the sharpening process is complete through reduced torque on the pencil. Pencil contact member 212 may also be mechanically linked (e.g., sliding link pin 216) to an electrical switch or other electrical device through carrier shaft 208 for providing motor shut-off or visual, audible, or vibratory indication that sharpening is complete. Alternatively, or additionally, the mechanical linkage may limit travel of the pencil-tip plate, either fixed or adjustable and either on-carrier or off-carrier, to provide pencil-point size (diameter) control.

With reference to FIG. 6, cutter-carrier assembly 404, which may be configured as either cutter-carrier assembly 100 or 200, described above, is adapted to be inserted into and easily removed from pencil sharpener housing 400 when cap assembly 406 has been removed. This aspect of the present invention facilitates accessing and replacing cutter-carrier assembly 404 when the helical cutters are no longer adequately functioning.

While the present invention has been illustrated by the description of exemplary embodiments thereof, and while the embodiments have been described in certain detail, there is no intention to restrict or in any way limit the scope of the appended claims to such detail. Additional advantages and modifications will readily appear to those skilled in the art. Therefore, the invention in its broader aspects is not limited to any of the specific details, representative devices and methods, and/or illustrative examples shown and described. Accordingly, departures may be made from such details without departing from the spirit or scope of the general inventive concept.

The invention claimed is:

1. A cutter-carrier assembly for use with pencil sharpeners, comprising:

a rotatable carrier having a center portion, wherein the center portion defines an interior cavity configured to receive a pencil to be sharpened;

a cutter rotatably and slidably mounted such that the cutter extends a predetermined distance into the interior cavity for removing material from the pencil being sharpened;

a contact plate mounted within the interior cavity, the contact plate being configured to move in the direction of the pencil being sharpened when a tip of the advancing pencil touches the contact plate;

a motor configured to rotate the rotatable carrier; and a switch coupled to the motor, the switch being configured to turn the motor off, wherein the cutter is configured to move in the same direction as the moving contact plate, wherein the cutter is configured to move outward from the interior cavity and away from the tip of the pencil being sharpened, wherein the pencil advances to a predetermined distance through the interior cavity.

2. The cutter-carrier assembly of claim 1, further comprising a sliding link pin coupled to the contact plate, wherein the sliding link pin is configured to trigger the switch to turn the motor off.

3. The cutter-carrier assembly of claim 1, further comprising:

a cutter pin coupled to the rotatable carrier, the cutter pin having a front portion and a rear portion, wherein the cutter is rotatably and slidably mounted on the cutter pin, wherein the contact plate comprises a first yoke coupled to the front portion of the cutter pin;

a second cutter pin coupled to the rotatable carrier, the second cutter pin having a front portion and a rear portion; and a second cutter rotatably and slidably mounted on the second cutter pin, wherein the contact plate comprises a second yoke coupled to the front portion of the second cutter pin.

4. The cutter-carrier assembly of claim 3, wherein the cutter and the second cutter are helical and equal in length and diameter.

5. The cutter-carrier assembly of claim 3, further comprising a housing, wherein the rotatable carrier, the cutter pin, the cutter, and the contact plate are stored within the housing.

6. The cutter-carrier assembly of claim 1, further comprising a mechanical linkage coupled to the rotatable carrier and at least one visual indication device configured to indicate that sharpening is complete.

7. The cutter-carrier assembly of claim 1, further comprising at least one spring coupled to the contact plate, wherein the at least one spring returns the contact plate to a starting position when the pencil is removed from the interior cavity.

8. The cutter-carrier assembly of claim 1, wherein the cutter disengages the pencil when the pencil is fully sharpened.

9. A cutter-carrier assembly for use with pencil sharpeners, comprising:

a rotatable carrier comprising a front portion, a center portion, and a back portion;

at least one cutter pin coupled to the rotatable carrier;

at least one cutter mounted on the at least one cutter pin;

a contact member coupled to the at least one cutter pin and configured to slide toward the back portion of the rotatable carrier when a pencil pushes the contact member;

a switch coupled to the contact member configured to slide with the contact member; and a motor configured to rotate the rotatable carrier, wherein the at least one cutter pin is configured to slide with the contact member away from the front portion of the rotatable carrier and radially outward from the center portion of the rotatable carrier as the at least one cutter pin slides toward the back portion of the rotatable carrier.

10. The cutter-carrier assembly of claim 9, wherein the switch is configured to turn-off the motor as the switch slides to the back portion of the rotatable carrier.

11. The cutter-carrier assembly of claim 9, wherein the rotatable carrier is configured to receive the pencil through the center portion.

12. The cutter-carrier assembly of claim 11, wherein the at least one cutter is configured to disengage the pencil as the contact member slides within the rotatable carrier.

13. The cutter-carrier assembly of claim 11, further comprising a spring mounted on the rotatable carrier, wherein the spring is configured to return the contact member and the at least one cutter pin to a starting position when the pencil is removed from the center portion of the rotatable carrier.

14. The cutter-carrier assembly of claim 9, wherein the at least one cutter is helical.

15. The cutter-carrier assembly of claim 9, wherein the at least one cutter is configured to rotate about the at least one cutter pin.

16. The cutter-carrier assembly of claim 9, further comprising a mechanical linkage between the rotatable carrier and at least one visual indication device.

17. The cutter-carrier assembly of claim 9, further comprising a pencil sharpener housing configured to store the rotatable carrier assembly within the pencil sharpener housing.

18. The cutter-carrier assembly of claim 9, wherein the at least one cutter disengages the pencil when the pencil is fully sharpened.

19. A cutter-carrier assembly for use with pencil sharpeners, comprising:

a rotatable carrier having a center portion, wherein the center portion defines an interior cavity configured to receive a pencil to be sharpened;

a first cutter rotatably and slidably mounted such that the first cutter extends a predetermined distance into the interior cavity for removing material from the pencil being sharpened;

a contact plate mounted within the interior cavity, the contact plate being configured to move in the direction of the pencil being sharpened when a tip of the advancing pencil touches the contact plate;

a first cutter pin coupled to the rotatable carrier, the first cutter pin having a front portion and a rear portion, wherein the first cutter is rotatably and slidably mounted on the first cutter pin, wherein the contact plate comprises a first yoke coupled to the front portion of the first cutter pin;

a second cutter pin coupled to the rotatable carrier, the second cutter pin having a front portion and a rear portion; and a second cutter rotatably and slidably mounted on the second cutter pin, wherein the contact plate comprises a second yoke coupled to the front portion of the second cutter pin, wherein the first cutter is configured to move in the same direction as the moving contact plate, wherein the first cutter is configured to move outward from the interior cavity and away from the tip of the pencil being sharpened, wherein the pencil advances to a predetermined distance through the interior cavity.

* * * * *